US005915624A

United States Patent [19]

Coldren et al.

[11] Patent Number: 5,915,624

[45] Date of Patent: Jun. 29, 1999

[54] FUEL INJECTOR UTILIZING A BIARMATURE SOLENOID

[75] Inventors: Dana R. Coldren, Fairbury; Marvin P. Schneider, East Peoria; David E. Martin, Normal; Glen F. Forck, Peoria, all of Ill.

[73] Assignee: Caterpillar Inc., Peoria, Ill.

[21] Appl. No.: 08/963,427

[22] Filed: Nov. 3, 1997

[51] Int. Cl.[6] ..... F02M 41/16; F02M 47/02; F16K 31/02

[52] U.S. Cl. ..... 239/96; 239/533.8; 251/129.16; 251/129.21

[58] Field of Search ..... 239/88, 96, 533.8, 239/585.1–585.5, 900; 251/129.15, 129.16, 129.21

[56] References Cited

U.S. PATENT DOCUMENTS 4,624,282 11/1986 Fargo ..... 251/129.21 X
4,972,996 11/1990 Cerny ..... 239/585.4
5,000,144 3/1991 Schweinzer et al. ..... 123/276
5,004,154 4/1991 Yoshida et al. ..... 239/533.8 X
5,263,647 11/1993 Cerny et al. ..... 239/585.1
5,307,991 5/1994 Hanson et al. ..... 239/1
5,337,961 8/1994 Brambani et al. ..... 239/397.5
5,339,063 8/1994 Pham ..... 335/260
5,341,994 8/1994 Wakeman ..... 239/585.5
5,427,319 6/1995 Bata ..... 239/585.4
5,463,996 11/1995 Maley et al. ..... 123/446
5,487,368 1/1996 Bruning ..... 123/470
5,488,340 1/1996 Maley et al. ..... 335/222
5,492,098 2/1996 Hafner et al. ..... 123/446
5,628,293 5/1997 Gisbon et al. ..... 239/585.2 X

*Primary Examiner*—Andres Kashnikow
*Assistant Examiner*—Steven J. Ganey

[57] ABSTRACT

A fuel injector solenoid includes a solenoid coil disposed in a stator, a flux conduction element carried by the stator and a flux blocking element disposed within a central recess of the stator and surrounded by the flux conduction element. First and second armatures are disposed in the central recess on opposite sides of the flux blocking element.

9 Claims, 4 Drawing Sheets

FUEL INJECTOR UTILIZING A BIARMATURE SOLENOID

TECHNICAL FIELD

The present invention relates generally to fuel injection apparatus, and more particularly to a fuel injector utilizing a solenoid as an actuating element.

BACKGROUND ART

Fuel injected engines employ fuel injectors, each of which delivers a metered quantity of fuel to an associated engine cylinder during each engine cycle. Prior fuel injectors were of the mechanically or hydraulically actuated type with either mechanical or hydraulic control of fuel delivery. More recently, electronically controlled fuel injectors have been developed. In the case of a mechanically actuated electronic unit injector, fuel is supplied to the injector by a transfer pump. The injector includes a plunger which is movable by a cam-driven rocker arm to compress the fuel delivered by the transfer pump to a high pressure. An electrically operated mechanism either carried outside the injector body or disposed within the injector proper is then actuated to cause fuel delivery to the associated engine cylinder.

In prior fuel injector designs, high pressure fuel is conducted through passages which are located outside of a central recess containing a solenoid which operates a valving mechanism. The passages are located close to the outer surface of the fuel injector and are formed by drilling intersecting holes. After drilling, portions of some of the holes must be filled with plugs. These passages and plugs are subjected to very high fluid pressures, thereby requiring careful design, thus increasing complexity and cost.

In addition to the foregoing, because the high pressure passages are located outside of the solenoid, the size of the solenoid is necessarily limited, thereby limiting the available solenoid force.

Still further, a prior type of fuel injector utilizes a direct operated check valve, which includes upper and lower valve seats which must be precisely aligned for proper operation. Manufacturing and assembly tolerances must, therefore, be kept tight, further increasing cost.

SUMMARY OF THE INVENTION

A solenoid for a fuel injector has a design which permits fuel flow to be directed substantially coincident with the. central axis of the fuel injector, thereby avoiding the disadvantages noted above.

More particularly, in accordance with one aspect of the present invention, a fuel injector solenoid includes a solenoid coil disposed in a stator. This stator has a central recess and a flux conduction element that is carried by the stator within a space encompassed by the solenoid coil. A flux blocking element is disposed within the central recess and is surrounded by the flux conduction element. First and second armatures are disposed in the central recess on opposite sides of the flux blocking element. Each of the armatures has at least a portion within the axial extent of the flux conduction element. Both armatures are movable in an axial direction away from the flux blocking element in response to current flowing in the solenoid coil.

Preferably, the flux blocking element is freely movable within the flux conduction element and is planar. Also in accordance with the preferred embodiment, the flux conduction element is cylindrical.

The stator is preferably C-shaped including a pair of outer legs in cross section and wherein each of the first and second armatures includes a flange which defines an air gap with an outer leg of the stator.

Still further in accordance with the preferred embodiment, the flux blocking element and the first and second armatures include cylindrical inner walls which are substantially coterminous with one another.

In accordance with another aspect of the present invention, a fuel injector solenoid includes an annular stator of magnetic material which is c-shaped in cross section and including a pair of outer legs and a center portion together defining a central recess. A solenoid coil is formed on a coil bobbin and is disposed in the central recess. A cylindrical flux conduction element is carried by the coil bobbin within the central recess and a flux blocking element is disposed within and extends radially inward from the flux conduction element. First and second armatures are disposed in the central recess on first and second sides, respectively, of the flux blocking element. Each of the armatures includes an annular outer flange forming an air gap with an associated outer leg of the stator. Each armature further includes an armature portion disposed within the axial extent of the flux conduction element and both armatures are movable in an axial direction away from the flux blocking element in response to current flowing in the solenoid coil.

The present invention permits the high pressure fuel passage to be placed at the center line of the injector, using a valving structure which avoids the need for intersecting holes and plugs and which avoids the valve alignment problems noted above.

BEST MODE FOR CARRYING OUT THE INVENTION

Figure 1:
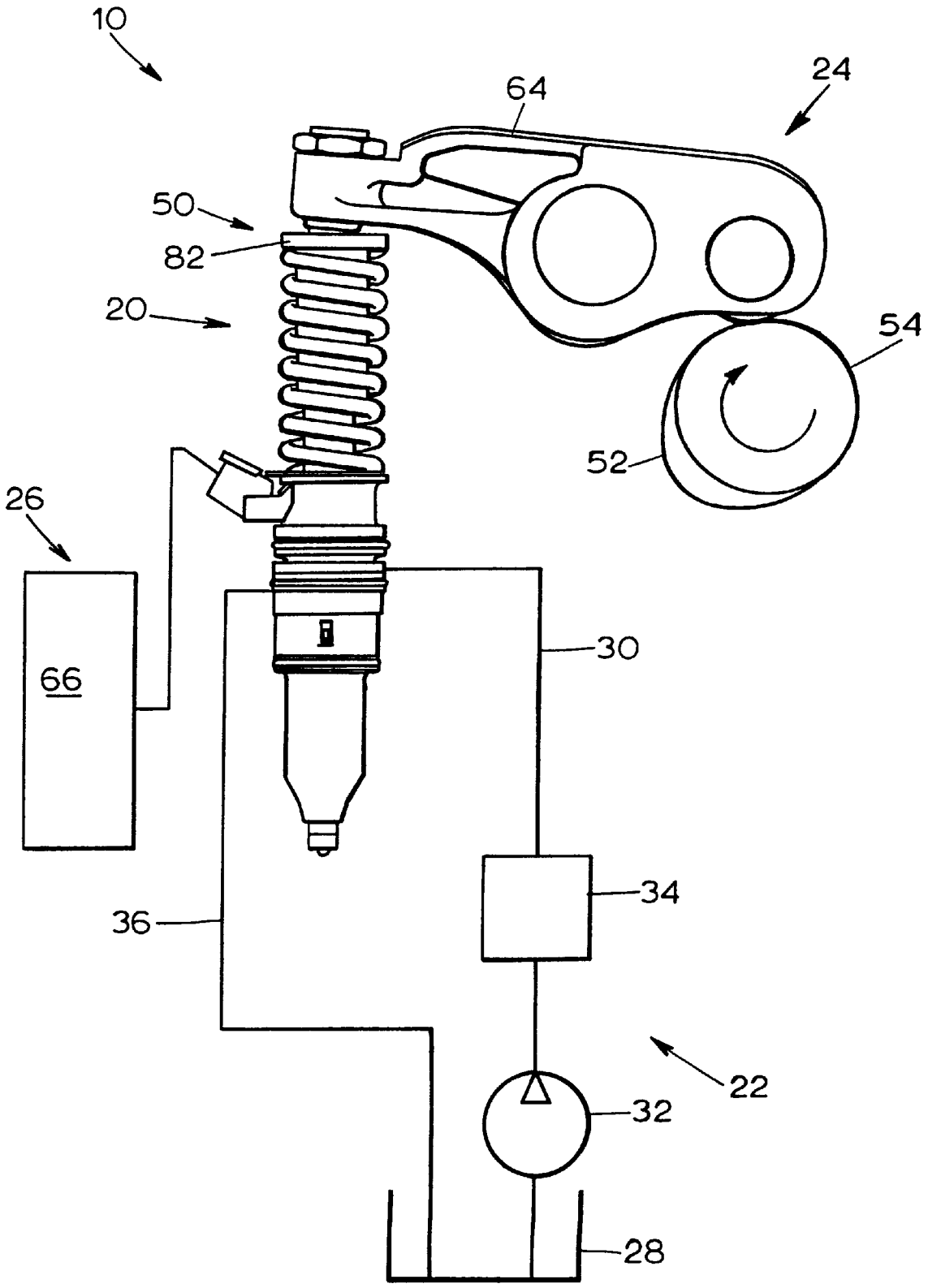
FIG. 1 is an elevational view of a fuel injector incorporating the present invention together with a cam shaft and rocker arm and further illustrating a block diagram of a transfer pump and a drive circuit for controlling the fuel injector.

Referring to FIG. 1, a portion of a fuel system 10 is shown adapted for a direct-injection diesel-cycle reciprocating internal combustion engine. However, it should be understood that the present invention is also applicable to other types of engines, such as rotary engines or modified-cycle cycle engines, and that the engine may contain one or more engine combustion chambers or cylinders. The engine has at least one cylinder head wherein each cylinder head defines one or more separate injector bores, each of which receives an injector 20 according to the present invention.

The fuel system 10 further includes apparatus 22 for supplying fuel to each injector 20, apparatus 24 for causing each injector 20 to pressurize fuel and apparatus 26 for electronically controlling each injector 20.

The fuel supplying apparatus 22 preferably includes a fuel tank 28, a fuel supply passage 30 arranged in fluid communication between the fuel tank and the injector 20, a relatively low pressure fuel transfer pump 32, one or more fuel filters 34 and a fuel drain passage 36 arranged in fluid communication between the injector 20 and the fuel tank 28. If desired, fuel passages may be disposed in the head of the engine in fluid communication with the fuel injector 20 and one or both of the passages 30 and 36.

The apparatus 24 may be any mechanically-actuating device or hydraulically-actuating device. In the embodiment shown, a tappet and plunger assembly 50 associated with the injector 20 is mechanically actuated indirectly or directly by a cam lobe 52 of an engine-driven cam shaft 54. The cam lobe 52 drives a pivoting rocker arm assembly 64 which in turn reciprocates the tappet and plunger assembly 50. Alternatively, a push rod (not shown) may be positioned between the cam lobe 52 and the rocker arm assembly 64.

The electronic controlling apparatus 26 preferably includes an electronic control module (ECM) 66 which controls: (1) fuel injection timing; (2) total fuel injection quantity during an injection cycle; (3) fuel injection pressure; (4) the number of separate injection segments during each injection cycle; (5) the time interval(s) between the injection segments; and (6) the fuel quantity delivered during each injection segment of each injection cycle.

Preferably, each injector 20 is a unit injector which includes in a single housing apparatus for both pressurizing fuel to a high level and injecting the pressurized fuel into an associated cylinder. Although shown as a unitized injector 20, the injector could alternatively be of a modular construction wherein the fuel injection apparatus 70 is separate from the fuel pressurization apparatus.

Figure 2:
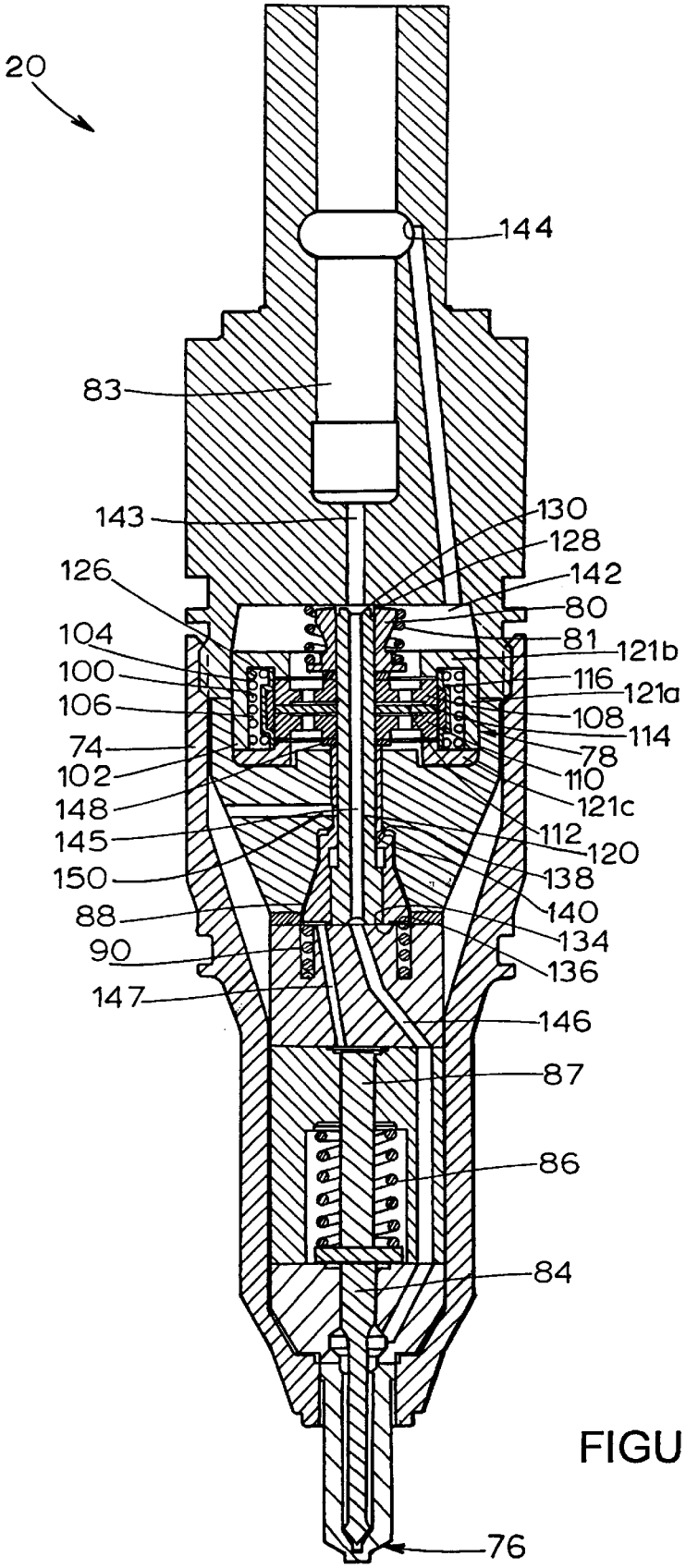
FIG. 2 is a fragmentary sectional view of the fuel injector of FIG. 1.
Figure 3:
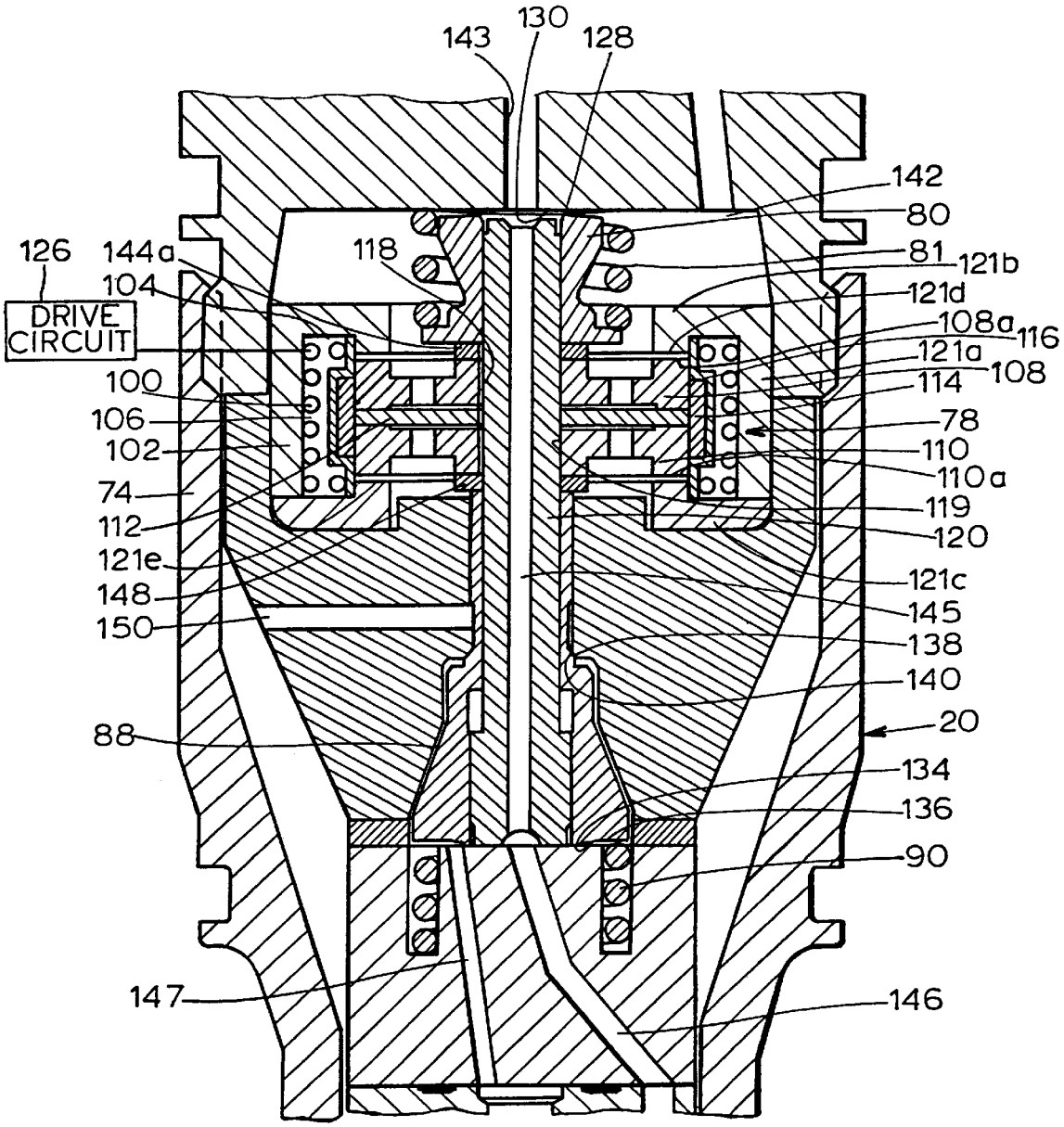
FIG. 3 is an enlarged, fragmentary sectional view of the fuel injector of FIG. 2 illustrating the solenoid in greater detail.

Referring now to FIGS. 2 and 3, the injector 20 includes a case 74, a nozzle portion 76, an electrical actuator 78, a spill valve 80, a spill valve spring 81, a plunger 82 disposed in a plunger cavity 83, a check 84, a check spring 86 surrounding a check piston 87 wherein the check 84 and the check piston 87 together comprise a check assembly, a direct operated check (DOC) valve 88 and a DOC spring 90. In the preferred embodiment, the spill valve spring 81 exerts a first spring force when compressed whereas the DOC spring 90 exerts a second spring force greater than the first spring force when compressed.

The electrical actuator 78 comprises a solenoid 100 for controlling the valves 80, 88. The solenoid 100 includes a c-shaped stator 102 of magnetic material having a recess 104 within which is disposed a solenoid coil 106. The solenoid 100 further includes an armature assembly comprising first and second annular armatures 108, 110, respectively, which are disposed on either side of an annular central spacer member 112 fabricated of nonmagnetic (i.e., high reluctance) material and which acts as a flux blocking element. The central spacer member 112 is planar and is disposed within and freely movable with respect to a cylindrical outboard flux conduction member 114. The flux conduction member 114 is fabricated of low reluctance material and is molded onto a coil bobbin 116 retained within the stator 102. The first and second armatures 108, 110 include portions which are located within the axial extent of the flux conduction member 114 and further include coterminous cylindrical inner walls 118, 119 which surround a central tube 120, as do the first and second valves 80, 88 and the central spacer member 112.

When current is applied to the solenoid coil 106, magnetic flux is developed which flows through a center portion 121*a* and outer legs 121*b*, 121*c* of the solenoid stator 102, the flux conduction member 114 and the first and second armatures 108, 110. The spacer member 112 blocks the passage of magnetic flux between the armatures 108, 110. In response to such application of current, each armature 108, 110 is axially urged toward an opposing outer leg 121*b*, 121*c*, respectively, of the stator 102 and away from the spacer member 112.

If desired, the central spacer member 112 may be alternatively secured to the cylindrical outboard flux conduction member 114, in which case, the outer leg 121*b* must be separate from the center portion 121*a* (like the outer leg 121*c*) to allow the various parts to be assembled before the outer legs 121*b*, 121*c* are secured to the center portion 121*a*.

Industrial Applicability

Figure 4:
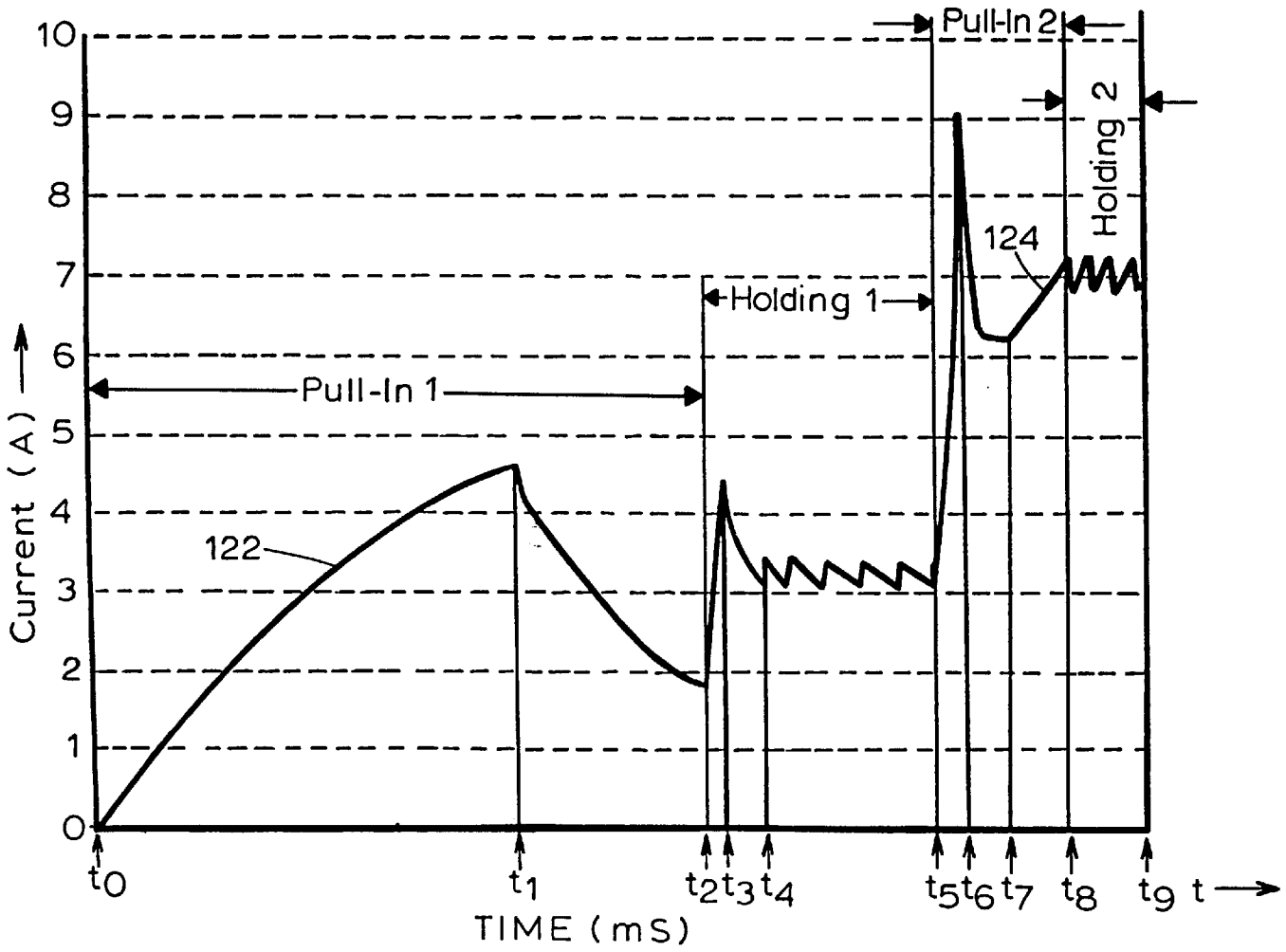
FIG. 4 is a waveform diagram illustrating current waveforms supplied to the solenoid coil of FIGS. 2 and 3.

FIG. 4 illustrates current waveform portions 122, 124 applied by a drive circuit 126 to the solenoid winding 106 during a portion of an injection sequence to accomplish fuel injection. The first current waveform portion 122 is applied between times $t=t_0$ and $t=t_5$ and the second current waveform portion 124 is applied subsequent to the time $t=t_5$. Between time $t=t_0$ and time $t=t_2$, a first pull-in current is provided to the solenoid winding 106 and a first holding current at somewhat reduced levels is thereafter applied between times $t=t_2$ and $t=t_5$. A second pull-in current of greater magnitude than the first pull-in current level is applied between times $t=t_5$ and $t=t_8$ and a second holding level greater in magnitude than the first holding level is applied between times $t=t_8$ and $t=t_9$.

More specifically, at the beginning of an injection sequence, the solenoid coil 106 is unenergized, thereby permitting the spill valve spring 81 (which exerts a first spring force) to open the spill valve 80 such that a sealing surface 128 is spaced from a valve seat 130. Also at this time, the DOC valve spring 90 (which exerts a second spring force greater than the first spring force) moves the DOC valve 88 upwardly to a position whereby a sealing surface 134 is spaced from a valve seat 136 and such that a further sealing surface 138 is in sealing contact with a further valve seat 140. Under these conditions, fuel enters a valve recess 142 and thereafter flows through a plunger passage 143, passages (not shown) in the plunger 82 and an annular groove 144 surrounding the plunger 82 to drain. Subsequently, the lobe on the cam pushes down on the plunger 82 of the injector 20, taking the passages in the plunger 82 out of fluid communication with the annular groove 144, so that fuel pressurization can then take place. The current waveform portion 122 is then delivered to the solenoid coil 106 by the drive circuit 126. The pull-in and holding current levels of the portion 122 and the valve springs 81, 90 are selected such that the motive force developed by the first armature 108 exceeds the first spring force developed by the spring 81 but the motive force developed by the second armature 110 is less than the second spring force developed by the spring 90. Consequently, the first armature 108 moves upwardly against a spacer 144*a* to reduce the size of an upper airgap between an annular outer flange 108*a* of the armature 108 and an annular face 121*d* of the outer leg 121*b* and closes the spill valve 80. At this point, the sealing surface 128 is moved into sealing contact with the seat 130, thereby isolating the plunger passage 143 from the valve recess 142. Also during this time, because the valve spring 90 exerts a greater spring force than the force developed by the second armature 110, the DOC valve 88 remains open in the previously described condition. Fluid pressurized by downward movement of the plunger 82 is thereby delivered through the plunger passage 143 and a central passage 145 in the central tube 120 to first and second check end passages 146, 147 leading to bottom and top ends, respectively, of the check assembly. Because the fluid pressures on the ends of the check assembly are substantially balanced, the check 84 remains closed at this time. Because the check 84 is closed, there is a smaller area exposed to the fuel pressure on the lower end of the check 84 than the area exposed to the fuel pressure at the upper end of the check assembly, and hence there is a net downward force which augments the spring force exerted by the check spring 86 to keep the check 84 closed The drive circuit 126 thereafter delivers the second current waveform portion 124 to the solenoid coil 106. This increased current level develops an increased force on the second armature 110 which exceeds the second spring force, causing such armature to move downwardly to reduce the size of an airgap between an annular outer flange 110*a* and an annular face 121*e* of the outer leg 121*c*. This downward movement is transmitted by a spacer 148 to the valve 88 to cause the valve 88 to also move downwardly such that the sealing surface 134 is moved into sealing contact with the valve seat 136. In addition, the sealing surface 138 moves out of sealing contact with the further valve seat 140. The effect of this movement is to isolate the second check end passage 147 from the high pressure fluid in the central passage 145 and to permit fluid communication between the second check end passage 147 and a passage 150 in fluid communication with drain (the connection between the passage 150 and drain is not shown in the Figs.). The pressures across the check assembly then become unbalanced, thereby driving the check upwardly and permitting fuel to be injected into an associated cylinder.

When injection is to be terminated, the current delivered to the solenoid coil 106 may be reduced to the holding level of the first current waveform portion 122 as illustrated in FIG. 4. If desired, the current delivered to the solenoid coil 106 may be reduced to zero or any other level less than the first holding level. In any case, the DOC valve 88 first moves upwardly, thereby reconnecting the second check end passage 147 to the passage 146. The fluid pressures across the check assembly thus become substantially balanced, allowing the check spring 86 and the fluid forces acting on the check assembly to close the check 84. The current may then be reduced to zero or any other level less than the first holding level, (if it has not been already so reduced). Regardless of whether the applied current is immediately dropped to the first holding level or to a level less than the first holding level, the spill valve spring 81 opens the spill valve 80 after the DOC spring 90 moves the DOC valve 88 upwardly.

If desired, the solenoid coil may receive more than two current waveform portions to cause either a single armature or multiple armatures to move to any number of positions (not just two), and thereby operate one or more valves or other movable elements.

Still further, multiple or split injections per injection cycle can be accomplished by supplying suitable waveform portions to the solenoid coil 106. For example, the first and second waveform portions 122, 124 may be supplied to the coil 106 to accomplish a pilot or first injection. Immediately thereafter, the current may be reduced to the first holding current level and then increased again to the second pull-in and second holding levels to accomplish a second or main injection. Alternatively, the pilot and main injections may be accomplished by initially applying the waveform portions 122 and 124 to the solenoid coil 106 and then repeating application of the portions 122 and 124 to the coil 106. The durations of the pilot and main injections (and, hence, the quantity of fuel delivered during each injection) are determined by the durations of the second holding levels in the waveform portion 124. Of course, the waveform shapes shown in FIG. 4 may be otherwise varied as necessary or desirable to obtain a suitable injection response or other characteristic.

As should be evident from the foregoing, the central passage 145 is substantially coincident with the central axis of the fuel injector 20 and is aligned at first and second ends with the ends of the plunger passage 143 and the first check end passage 146, respectively. Because the solenoid design permits fuel to be directed along the center of the injector, high pressure intersecting holes and plugs are not required. Further, there is no need to align the lower valve seat of the DOC valve 88. The valve can be made with fewer parts and the number of steps required to manufacture the valve is reduced. Still further, more space is available for components and/or the size of the injector can be reduced.

Numerous modifications and alternative embodiments of the present invention will be apparent to those skilled in the art in view of the foregoing description. Accordingly, this description is to be construed as illustrative only and is for the purpose teaching those skilled in the art the best mode of carrying out the invention. The details of the structure and/or function may be varied substantially without departing from the spirit of the invention, and the exclusive use of all modifications which come within the scope of the appended claims is reserved.

We claim:

1. A fuel injector solenoid, comprising:

a solenoid coil disposed in a stator having a central recess;

a flux conduction element carried by the stator within a space encompassed by the solenoid coil and having an axial extent;

a flux blocking element disposed within the central recess and surrounded by the flux conduction element; and first and second armatures disposed in the central recess on opposite sides of the flux blocking element and each having at least a portion within the axial extent of the flux conduction element and both being movable in an axial direction away from the flux blocking element in response to current flowing in the solenoid coil.

2. The fuel injector solenoid of claim 1, wherein the flux blocking element is freely movable within the flux conduction element.

3. The fuel injector solenoid of claim 1, wherein the flux blocking element is planar.

4. The fuel injector solenoid of claim 1, wherein the flux conduction element is cylindrical.

5. The fuel injector solenoid of claim 1, wherein the stator is C-shaped including a pair of outer legs in cross-section and wherein each of the first and second armatures includes a flange which defines an airgap with one of the outer legs of the stator.

6. The fuel injector solenoid of claim 1, wherein the flux blocking element and the first and second armatures include cylindrical inner walls which are substantially coterminous with one another.

7. A fuel injector solenoid, comprising:

an annular stator of magnetic material and which is C-shaped in cross-section and including a pair of outer legs and a center portion together defining a central recess;

a solenoid coil formed on a coil bobbin and disposed in the central recess;

a cylindrical flux conduction element carried by the coil bobbin within the central recess and having an axial extent;

a flux blocking element disposed within and extending radially inwardly from the flux conduction element; and first and second armatures disposed in the central recess on first and second sides, respectively, of the flux blocking element and each having an annular outer flange forming an airgap with one of the associated outer legs of the stator and each armature further including an armature portion disposed within the axial extent of the flux conduction element and both being movable in an axial direction away from the flux blocking element in response to current flowing in the solenoid coil.

8. The fuel injector solenoid of claim 7, wherein the flux blocking element is planar.

9. The fuel injector solenoid of claim 8, wherein the first and second armatures include cylindrical inner walls which are substantially coterminous with one another.

* * * * *